US005968447A

United States Patent [19]

Pavlicevic et al.

[11] Patent Number: 5,968,447

[45] Date of Patent: Oct. 19, 1999

[54] TAPPING METHOD FOR ELECTRIC ARC FURNACES, LADLE FURNACES OR TUNDISHES AND RELATIVE TAPPING DEVICE

[75] Inventors: Milorad Pavlicevic, Udine, Italy; Peter Tishchenko, Donezk, Ukraine; Alfredo Poloni, Fogliano di Redipuglia; Gianni Gensini, Buia, both of Italy

[73] Assignee: Danieli & C. Officine Meccaniche SPA, Buttrio, Italy

[21] Appl. No.: 08/955,359

[22] Filed: Oct. 21, 1997

[30] Foreign Application Priority Data

Oct. 21, 1996 [IT] Italy ..... UD96A0202

[51] Int. Cl.[6] ..... B22D 41/08

[52] U.S. Cl. ..... 266/45; 266/237; 222/592; 222/600

[58] Field of Search ..... 266/45, 237; 222/590, 222/592, 593, 600

[56] References Cited

U.S. PATENT DOCUMENTS

| | | | |
|---|---|---|---|
| 4,971,294 | 11/1990 | Sherrill | 222/593 |
| 5,294,096 | 3/1994 | Muller | 266/237 |
| 5,350,159 | 9/1994 | Parker | 266/237 |

FOREIGN PATENT DOCUMENTS

| | | |
|---|---|---|
| 234572 | 9/1987 | European Pat. Off. . |
| 560494 | 9/1993 | European Pat. Off. . |
| 1527380 | 9/1968 | France . |
| 440859 | 1/1936 | United Kingdom . |
| 1159736 | 7/1969 | United Kingdom . |

OTHER PUBLICATIONS

Patent Abstracts of Japan vol. 12, No. 286 (M–727), Aug. 5, 1988 & JP 63 063566 (Nippon Kokan) Mar. 19, 1988 Abstract.

*Primary Examiner*—Scott Kastler

*Attorney, Agent, or Firm*—Antonelli, Terry, Stout & Kraus, LLP

[57] ABSTRACT

Tapping method for molten metal from containers (13) including at the lower part a tapping channel (14) associated at the end part with a discharge hole (15) substantially vertical or sub-vertical, the discharge hole (15) being associated at the lower part with a sliding interception device (19), wherein the tapping channel (14) comprises, associated with the walls, an electromagnetic device (17) with spirals (18) and a system for cooling the walls, wherein, during the end-of-tapping step of the liquid metal the sliding interception device (19) is activated by closing the discharge hole (15) and allowing the metal in the tapping channel (14) to solidify so as to form at least a layer which lines both the tapping channel (14) and the discharge hole (15) filling it completely, and that during the start-of-tapping step the sliding interception device (19) is activated by leaving the discharge hole (15) free and the metal which is blocking the discharge hole (15) is melted by means of the electromagnetic device (17) by varying the characteristics of the current flow.

Tapping device which achieves the method as described above and comprising means (38) to feed the electromagnetic device (17) with electric current as a function of the steps of melting and tapping, the sliding interception device (19) comprising a first part (23*a*) with a high resistance to heat shock, corrosion and erosion and a second part (23*b*), positioned adjacent to the first part (23*a*), with high heat conductivity.

22 Claims, 3 Drawing Sheets

TAPPING METHOD FOR ELECTRIC ARC FURNACES, LADLE FURNACES OR TUNDISHES AND RELATIVE TAPPING DEVICE

BACKGROUND OF THE INVENTION

This invention concerns a tapping method and the relative device for electric arc furnaces, ladle furnaces or tundishes.

The invention is applied in the siderurgical field to achieve a controlled discharge, from the bottom or from the side, of the liquid metal, such as steel or its alloys, contained in melting volumes and in particular in electric arc furnaces and in ladle furnaces or in tundishes.

The state of the art covers electric arc furnaces and ladle furnaces or tundishes, or more generally melting volumes, on the bottom of which there is a casting channel which, thanks to the appropriate interception devices, can be opened on command to allow the liquid metal to be tapped when the melting cycle is complete.

In the state of the art, these devices normally comprise a plug element whose function is to close the tapping channel; at the end part of the tapping channel there is a quantity of sand which separates the liquid metal from the surface of the plug element.

When tapping is carried out, the plug element is opened and the liquid steel begins to flow down from the furnace once the sand has completely come out from the tapping channel.

This kind of application is particularly used in furnaces where the tapping channel is located in an eccentric position with respect to the floor of the hearth.

Because of this position, problems have often been found in the functioning of the furnace, causing increases in costs and danger for the workers in the area around the tapping area.

A first disadvantage is that the liquid metal often impregnates the sand inside the tapping channel and solidifies there or adheres at least partially to the walls of the channel.

This makes it necessary to intervene manually to free the tapping channel.

More particularly, it may be necessary to use a jet of oxygen to melt the solid plug which is created on the walls of the tapping channel, and this procedure may cause grave risks to the safety of the workers.

Moreover, this jet of oxygen causes great and premature wear in all those parts affected by the jet, which causes problems of a practical nature during the tapping step and extra costs for the replacement and/or maintenance of those components subject to wear.

This kind of device is also used when tapping is carried out from the sides of the furnace.

In this case, in some applications known to the state of the art, a device is used to intercept the flow of liquid metal which consists of a mechanical translation device, located at the sides on the vertical walls of the hearth, to close the tapping channel.

The axis of the tapping channel is placed in a sub-horizontal position.

The mechanical device is not cooled and substantially consists of a plate with a hole for the liquid metal to pass through.

The translation of the device only occurs through the interception of the liquid metal, after which the furnace is rotated in the opposite direction by an angle sufficient to prevent contact between the liquid metal and the tapping device.

Even if the absence of sand prevents the above-mentioned disadvantage from occurring, this system of tapping also has considerable disadvantages, such as for example a high energy consumption, an increase in the times of the production cycle so as to allow the furnace to be rotated, and also a heavy wear of the components.

The prior art document GB-A-440.859 provides a furnace which serves to cast liquid metal at progressively reduced speeds inside already finished casting molds.

This document teaches that the tapping hole is closed by a metallic plug during the preparatory phase of the bath of liquid metal. The plug is then melted by means of an induction coil so that the metal can be tapped.

This document teaches to use a pre-constituted plug, it does not teach to use mechanised closing systems.

FR-A-1.527.380 and JP-A-63-063566 teach to conserve the nozzle for casting by maintaining a solid skin in contact with the inner walls of the furnace through which the casting nozzle passes.

An induction heating device is included to control the thickness of the skin and to keep hot the molten metal passing through.

The resultant device is only useful during the tapping step.

EP-A-0.234.572 is substantially identical in its teaching to FR-A-1.527.380 associated with a sliding valve. According to the teachings of EP-A-0.234.572, the solidification of metallic parts in connection with the sliding valve is an undesired effect and therefore these teachings are only useful during the tapping step.

Not one of the prior art documents we have now considered teaches, or leads to consider, how to provide for the closure of the tapping hole and the automatic management of this closure both at the end-of-tapping step and at the start-of-tapping step.

SUMMARY OF THE INVENTION

The present applicants have designed, tested and embodied this invention to overcome the shortcomings of the state of the art and to provide further advantages.

The purpose of the invention is to provide a tapping method and the relative device for the liquid metal in an electric arc furnace or ladle furnace or tundish which will achieve an automatic system of interception, so as it is possible to interrupt the flow of liquid metal by means of a highly reliable mechanical device, and without the need to move or rotate the furnace.

The invention is applied in electric arc furnaces, ladle furnaces and tundishes with a tapping channel which has a vertical or sub-vertical axis and is located on the floor of the container of molten metal in a substantially central position, or in an eccentric position, or at the sides on the walls.

The device according to the invention makes it possible to obtain a cast product without any impurities, a reduction in the cycle times and consequently high productivity, optimum maintenance conditions, reduction of energy consumption and better safety conditions for the workers.

According to the invention, the tapping channel is cylindrical in shape, with a vertical or sub-vertical axis, and is surrounded by protective refractory material.

According to a variant, the tapping channel is conical in shape.

At the lower part, in one embodiment of the invention, the tapping channel widens towards the bottom in order to prevent or at least limit as much as possible the contact of the liquid metal with the walls, during the tapping step.

This widening in section is then followed by a segment in the shape of a truncated cone converging towards the bottom with an inclination of between 0 and 15°.

The lower part of the tapping channel includes cooling means with cooling fluid circulating inside, in order to cause the solidification of a layer of metal which is in contact with the walls of the tapping channel.

In one embodiment of the invention, this lower part of the tapping channel is composed of refractory material.

According to a variant, the lower part is composed of ceramic material.

According to a further variant, the lower part is composed of a composite metal with a high resistance to heat and wear.

According to the invention, outside the tapping channel and in cooperation with the walls of the same, there is an electromagnetic device composed of a winding located substantially coaxial with the tapping channel.

The intensity and frequency of the current which feeds the winding are variable and controlled according to the various steps of the melting process.

The possibility of regulating the current enables the growth of the thickness of the solid metal in the tapping channel to be likewise controlled, and it is also possible to modulate the intensity and amplitude of the electromagnetic action inside the tapping channel.

This electromagnetic action may in fact cause either a simple remixing of the liquid metal inside the tapping channel, or it may also cause a Joule effect which is sufficient to melt, entirely or partially as necessary, the solidified metal in correspondence with the device to intercept the liquid metal.

According to one embodiment of the invention, the end part of the tapping channel is composed of a crystalliser system made of copper, cooled by means of a system of circulating cooling fluid and lined on the inside by a layer of heat and electric insulating material.

This insulating layer prevents any electrical contact between the copper walls and the liquid metal contained in the tapping channel.

The winding located outside the copper walls induces currents in the copper which in turn induce currents in the liquid metal, increasing the Joule effect on the volume of the metal inside the tapping channel.

As a consequence of these induced currents, and of the cooling system of the copper walls, the metal in the tapping channel remains substantially liquid or semi-liquid in the central part of the tapping channel and on the contrary tends to solidify in correspondence with the peripheral region.

In this peripheral region, a hard and resistant solidified layer is created which lines the copper walls and permanently prevents them from eroding and corroding due to the high temperature of the metal, both when it is stationary during the melting step, and when it is moving during the tapping step.

According to a further solution, the induction of the currents inside the liquid metal is achieved directly, and obtained from the metallic walls of the tapping channel, as the cooling system is located circumferentially inside channels made in the thickness of the walls of the tapping channel.

Thus a configuration is achieved which reproduces a series of adjacent coils.

According to a variant of this embodiment, there are ferromagnetic plates to intensify the electromagnetic field located on the outside of the walls of the tapping channel.

The walls of the tapping channel are lined on the inside with electrically insulating material.

The combined action of the electromagnetic device and the cooling system therefore causes the formation of an outer layer of solidified metal which protects the walls of the tapping channel, while in the central part the metal is maintained in a liquid or semi-liquid state by the Joule effect generated by the currents induced.

The tapping device according to the invention comprises at its lower part an interception device which is suitable to stop the flow of liquid metal, thus causing a layer of solidified metal to be formed above it.

In one embodiment of the invention, this interception device is composed of at least two parts, one located at the side of the other; one of these has a high heat resistance and serves to intercept the flow of liquid metal during the initial phase, while the other part, which is cooled, serves to control the solidified part of the metal above the interception device.

According to the invention, the first part of the interception device comprises at least a plate made of a material which is highly resistant to heat and highly resistant to corrosion and erosion.

The preferred materials for making this plate, in the absence of autonomous cooling systems, are alumina ($Al_2O_3$), zirconium oxide ($ZrO_2$), aluminium boride ($AlB_2$), aluminium nitride (AlN), aluminium and boron nitrate ($AlBN_2$), zirconium bromide ($ZrB_2$) and generally those materials which are normally used as a heat screen.

The function of this plate is to ensure resistance against heat shock and against the erosion and corrosion caused by the initial flow of liquid metal.

In one embodiment of the invention, the plate is made of a supporting metallic element lined with one or more protective layers, even several layers, which have a high resistance to heat and a high mechanical resistance.

According to a variant, one or more of these layers have slots and/or notches suitable to reduce the apparent total heat conductivity, and to increase their deformability.

Once the flow of steel has been intercepted by means of the tapping hole being closed, the interception device can be translated in order to move its second part into correspondence with the tap-hole; this second part has a higher heat conductivity, for example given by the presence of an appropriate cooling system.

In one embodiment of the invention, the surface of this second part is lined with layers of material which has a high resistance to heat shock, to corrosion and to erosion.

In one embodiment of the invention, the surface of this part, with its high heat conductivity, includes slots and/or notches and is lined with material which solid steel cannot stick to.

This lining can be made, in one solution, of soft and resistant powder, for example boron nitride or nitrate of boron and aluminium.

The heat expansion of the lining material will produce a separation between the liquid metal and the lower, solid part of the cooled plate; this separation makes it possible to prevent the metal being welded directly onto the interception device, thus ensuring that it will be free and independent to move, and protected from wear.

The function of the solid layer which forms above the interception device is to significantly reduce the heat flow towards the plate, thus exploiting the retraction of the material caused by its solidification.

Before the thickness of the solidified metal achieves a crystalline structure, which is extremely hard and abrasive, the interception device is again displaced so as to distance it from the solid metal.

In one embodiment of the invention, the interception device is displaced vertically and kept at a distance of some millimeters, introducing another heat resistance by means of the laminar layer of air which is created below the plug of metal.

This position of the interception device is maintained principally for safety reasons, while the support function principally consists of the volume of solidified steel.

In the following step, the interception device can be again positioned in such a way that its part with the higher heat resistance corresponds with the tap-hole.

This limits energy losses from the inside of the furnace, inhibits the progression of the front of solidified metal towards the inside of the furnace and also serves to facilitate the action of the electromagnetic device located in correspondence with the walls of the tapping channel.

This electromagnetic device, apart from maintaining the metal in the central part of the tapping channel substantially liquid, preventing its widespread solidification, and making the temperatures uniform during the stirring action, is also used in the final phase, along the walls of the channel, to melt at least partially the solid plug of metal which has formed in correspondence with the interception device.

This is obtained by varying in the appropriate manner the levels of intensity and frequency of the current, so as to allow the tap-hole to be opened in the shortest possible time.

BRIEF DESCRIPTION OF THE DRAWINGS

The attached figures are given as a non-restrictive example and show some preferred embodiments of the invention as follows.

DETAILED DESCRIPTION OF THE PREFERRED EMBODIMENTS

Figure 1:
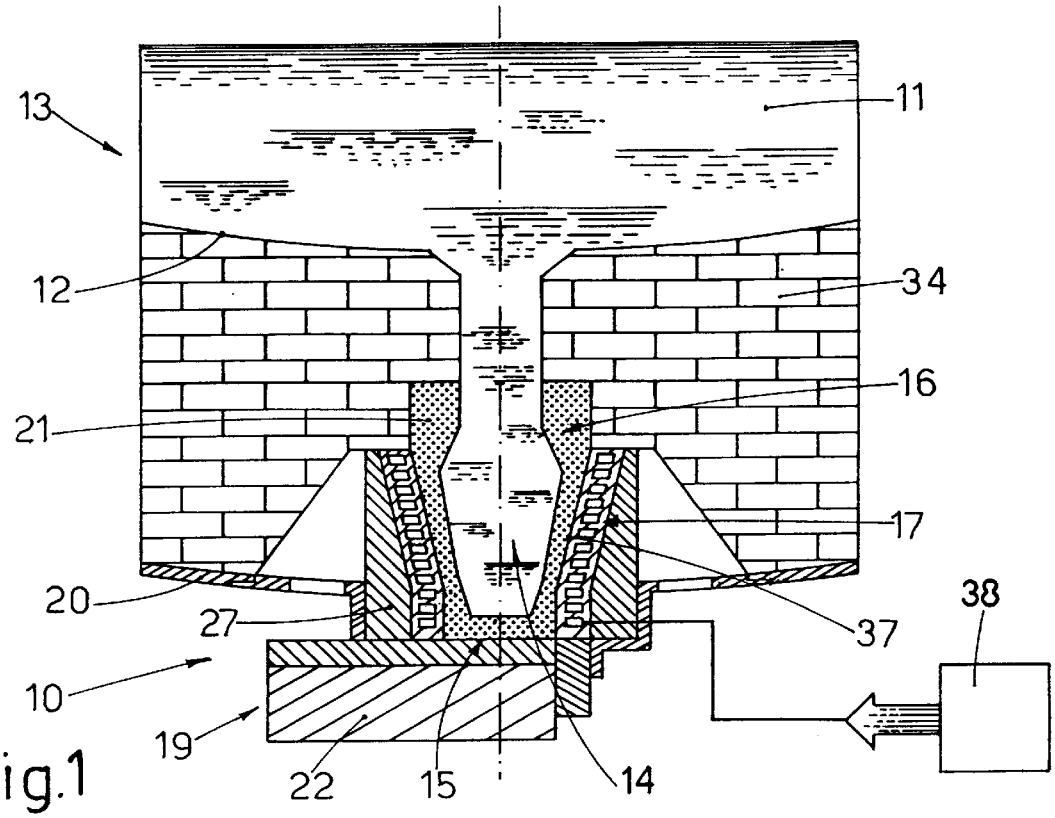
FIG. 1 shows the tapping device according to the invention during the melting step.
Figure 2:
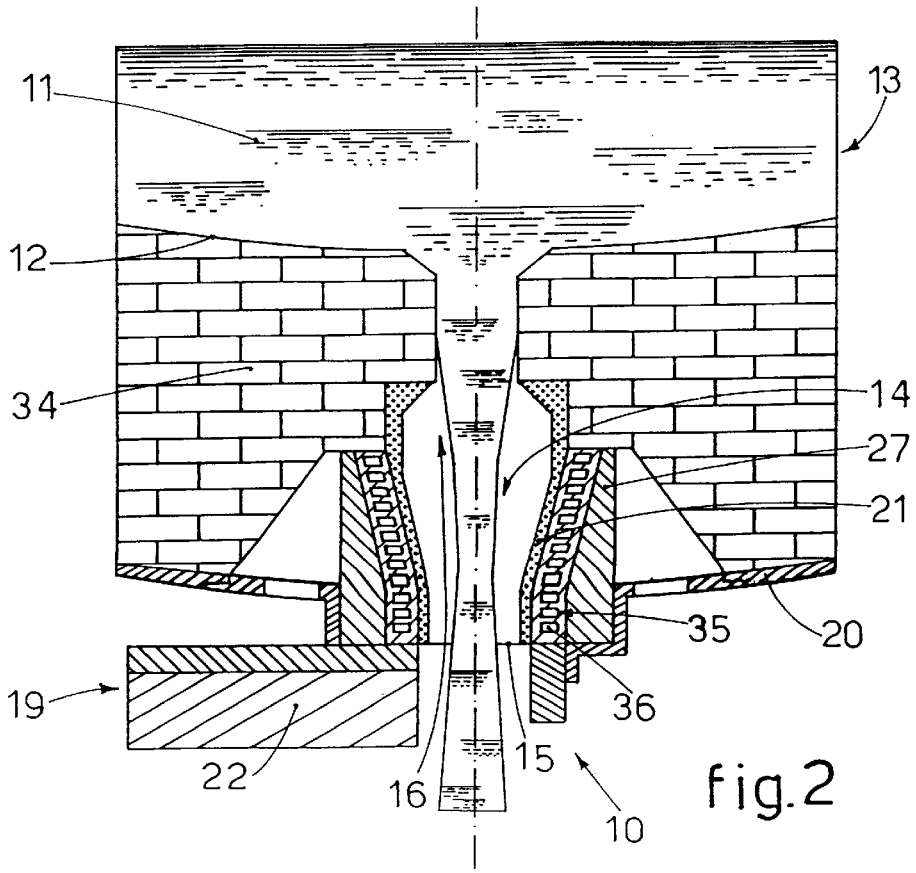
FIG. 2 shows the device in FIG. 1 during the tapping step.

The tapping device 10 for liquid metal 11 according to the invention is applied on the floor 12 of any container 13, such as for example an electric arc furnace or a ladle furnace or tundish or any other type.

The container 13 has at its lower part a tapping channel 14 lined by an outer protection of refractory material 27, ending at the bottom in a discharge hole 15.

According to a variant, the outer protection 27 is made of a material of ferromagnetic intensification.

Outside the lower standard part in refractory 34 of the furnace 10 there is a protective lining in steel.

The tapping channel 14 at its upper part is substantially cylindrical or conical in shape, and at a substantially intermediate position, it includes a chamber with a greater diameter 16 which communicates with the discharge hole 15.

The chamber with a greater diameter 16 allows a layer of solidified metal 21 to be formed, which has the function of protecting the walls of the tapping channel 14, preventing it from corroding or eroding; it also serves to prevent any prolonged contact, during the tapping step, between the liquid metal 11 and the walls of the tapping channel 14.

The chamber with the greater diameter 16 is then followed by a segment shaped like a truncated cone 37 converging towards the bottom at an angle of between 0 and 15°.

The walls of the tapping channel advantageously consist of an insert made of ceramic or composite metallic material, or even in refractory, inside which there are channels for the circulation of the cooling fluid. The cooling fluid can consist of water, air, liquid metal, a mixture, or another substance.

Outside the tapping channel 14 and coaxial with it, there is an electromagnetic device 17.

The spirals 18 of the electromagnetic device 17 are fed by the appropriate currents supplied by a feeder, not shown here, so as to generate an electromagnetic field suitable to stop and hold the flow of liquid metal 11 which, at the beginning of the cycle, starts to flow from the container 13 through the tapping channel 14.

At the beginning of the melting cycle, the main function of the electromagnetic device is to determine a stirring or mixing action of the metal in the tapping channel 14.

In this situation, the cooling action performed by the cooling fluid circulating in the channels adjacent to the tapping channel 14 causes a rapid and controlled solidification of the liquid metal 11, with a consequent formation of a solid layer 21 in the tapping channel 14 in a position adjacent to its walls.

Figure 3:
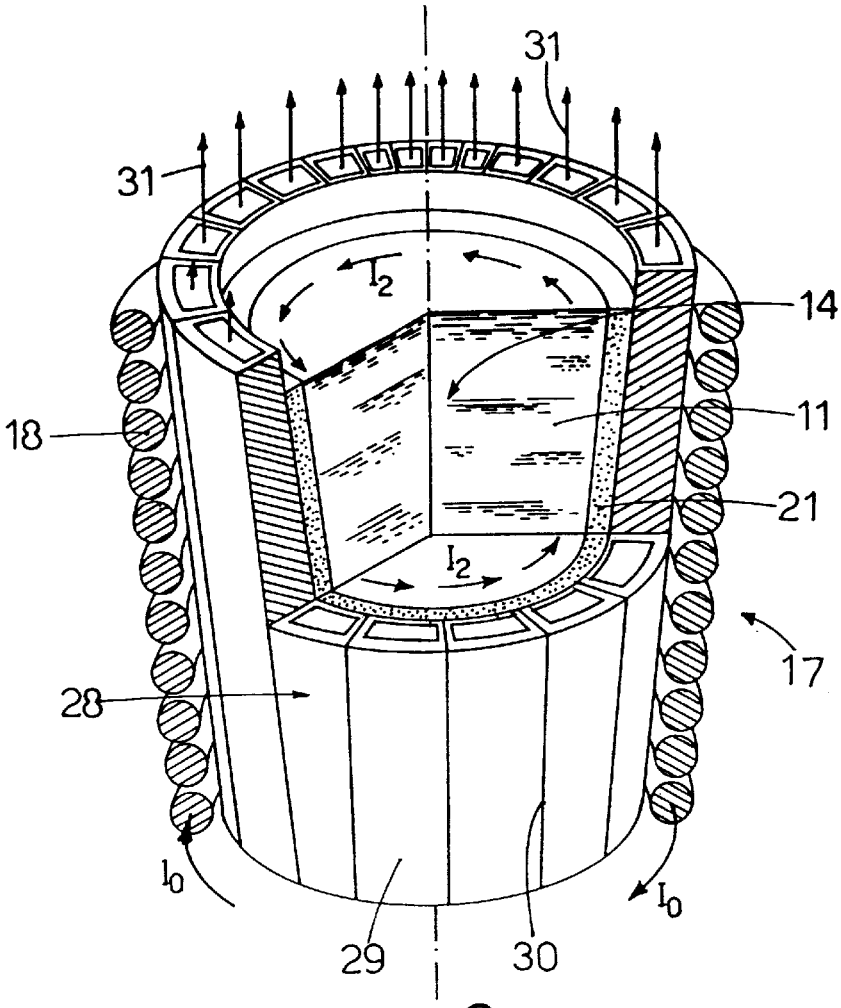
FIG. 3 shows an embodiment of the tapping device according to the invention.

In the solution shown in FIG. 3, the walls of the tapping channel 14 are composed of a crystalliser system 28 comprising a plurality of hollow modular elements 29, inside which the cooling fluid, referenced with the number 31, flows.

The spirals 18 are arranged outside the crystalliser system 28 and are fed by the appropriate current $I_0$ which is controlled by means 38 which correlate the current to every step of the melting/tapping cycle also according to the behaviour of the cooling system.

Between the copper walls of the crystalliser system 28 and the liquid metal 11 there is a layer 30 of electric and heat insulation.

The presence of the crystalliser system 28 causes an intensification of the value of the induced currents $I_2$ in the liquid metal inside the tapping channel 14 starting with the feed current $I_0$.

In the embodiments shown in FIGS. 1, 2 and 4*a* to 4*d*, induction takes place directly due to the presence of the metallic wall 35 inside which there are circumferential channels 36 for the circulation of the cooling fluid.

At the lower part of the discharge hole 15 there is an interception device 19 comprising a mechanical interception element 22 which can be translated at least in a direction at right angles to the vertical or sub-vertical axis of the discharge hole 15 itself.

In this case, the interception device 19 is composed of two parts, arranged one next to the other and horizontal.

Figure 4A:
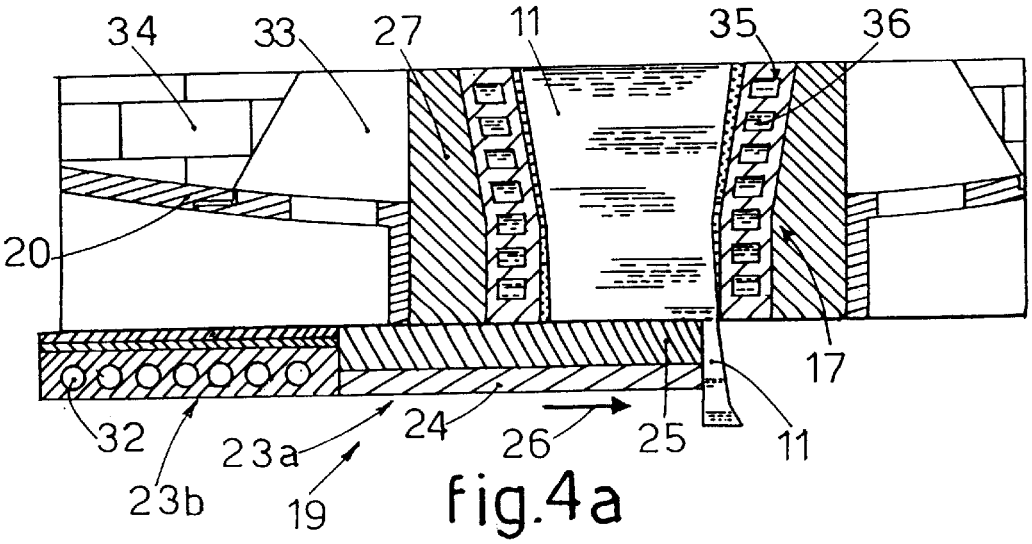
FIGS. 4*a*, 4*b*, 4*c* and 4*d* show the working cycle of the interception device according to the invention.

A first part 23*a* possesses a high resistance to heat and is placed below the discharge hole 15 during the start-up step of the melting process (FIG. 4*a*). The function of this first part 23*a* is to resist the high heat shock, and also the corrosion and erosion, caused by the flow of liquid metal which flows through the tapping channel 14.

The first part 23*a* consists, in this case, of a supporting metallic element 24 at the upper part of which there are one or more protective layers 25. These protective layers have high heat and mechanical resistance, and possibly include slots and/or notches to reduce the heat conductivity.

Figure 4B:
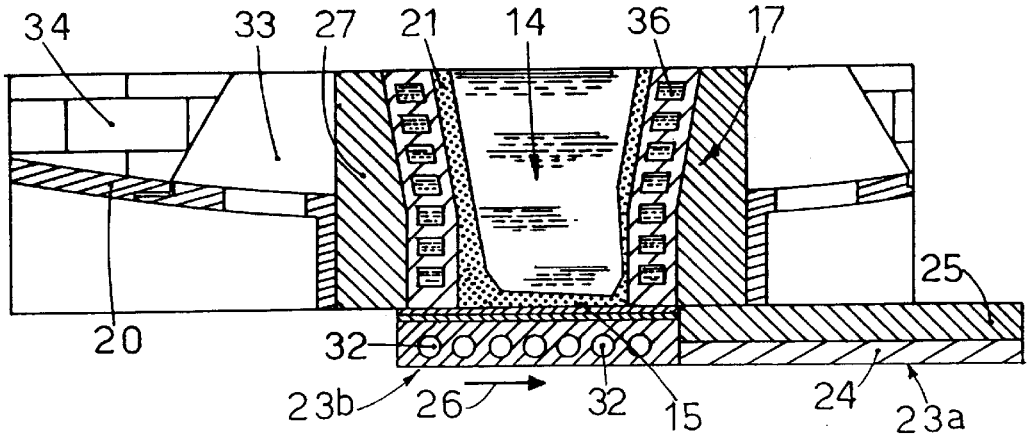

After having intercepted the first flow of steel, the interception device 19 is translated horizontally, in the direction 26, to put into position under the discharge hole 15 its second part 23*b* which has greater heat conductivity than the first part 23*a* (FIG. 4*b*).

In this case, the second part 23*b* includes a cooling system with channels 32 for the circulation of the cooling fluid.

The function of the cooling system is to obtain, above the interception device 19, a layer of solidified metal 121 which functions substantially as a plug, thus significantly reducing the heat flow transmitted by the liquid metal with respect to the contraction of the metal as a consequence of its solidification.

According to a variant, when the layer of solidified metal 121 has formed, and before it assumes a hard and abrasive crystalline quality, the interception device 19 is displaced downwards; the purpose of this displacement is to separate the device 19 from the solidified metal 121 so as to prevent them sticking and to therefore maintain freedom and autonomy of movement.

Figure 4C:
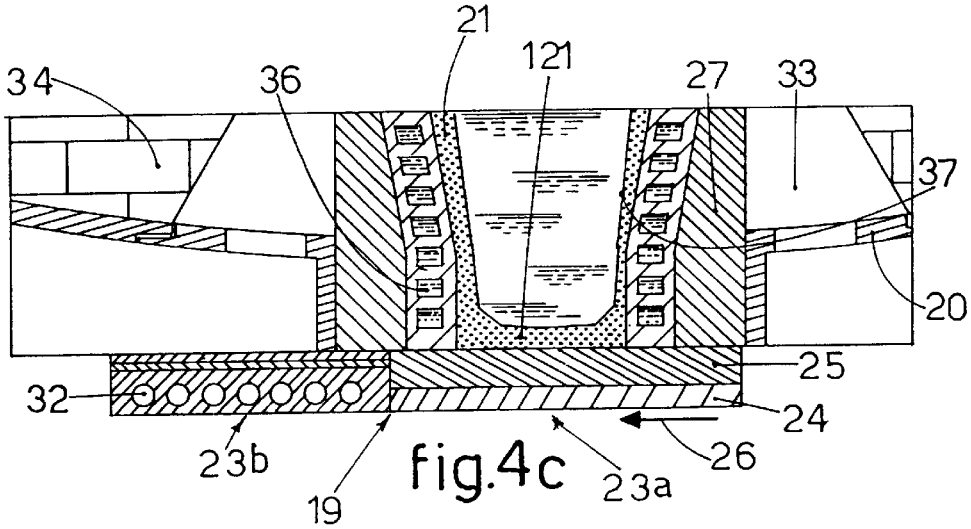
Figure 4D:
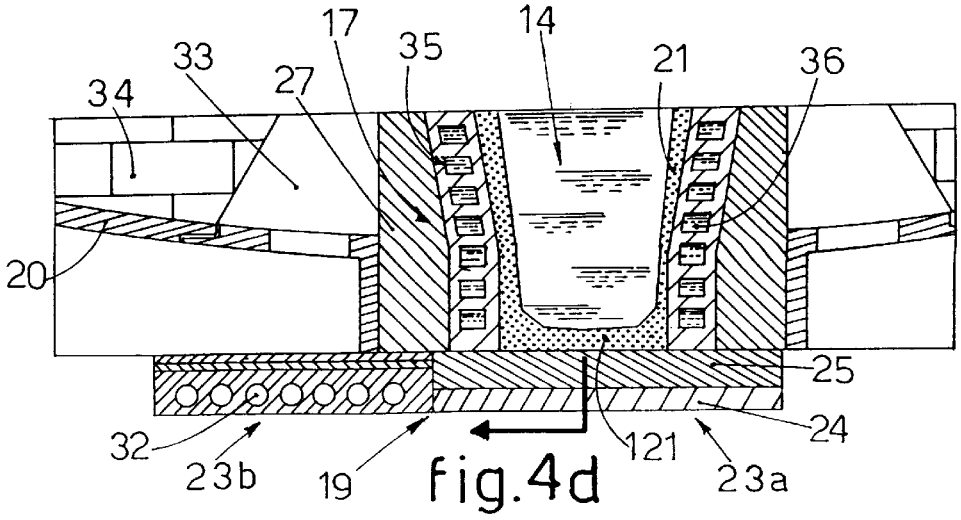

In order to reduce energy losses towards the outer environment from inside the furnace, and to reduce the progression of the solidified metal 121 in the tapping channel 14, the next step is to locate again under the discharge hole 15 the first part 23*a* of the interception device 19, that is, the part with the greatest heat resistance (FIG. 4*c*).

According to a variant not shown here, the interception device 19 comprises a third part, highly resistant to heat, which is placed in correspondence with the discharge hole 15 during the melting cycle. This third part can also consist of the first part 24–25 which is taken underneath the discharge hole by means of a displacement in the opposite direction to the previous one.

When the tapping is carried out, the interception device 19 is brought into a position of non-contact with the discharge hole 15 (FIGS. 2 and 4*d*) and the electromagnetic device 17 is activated with currents having an intensity and frequency such as to determine, by means of the Joule effect, the melting of the plug of solidified metal 121.

This makes it possible to free the discharge hole 15 and to proceed with the tapping of the liquid metal 11 through the tapping channel 14.

Outside the material which defines the walls of the tapping channel 14 there is, in this case, an empty safety chamber 33.

We claim:

1. Tapping method for molten metal from containers, the containers including at a lower part a tapping channel having an end part with a discharge hole substantially vertical or sub-vertical, the discharge hole being closed at the lower part, at least temporally, with a sliding interception device, wherein the tapping channel comprises an electromagnetic device provided adjacent walls of the tapping channel and a system for cooling the walls, the method being characterised in that during an end-of-tapping step of the liquid metal, the sliding interception device is activated by closing the discharge hold and the system for cooling the walls is activated to solidify metal in the tapping channel so as to form at least a layer which lines both the tapping channel and the discharge hold filling it completely, and that during a start-of-tapping step the sliding interception device is activated by leaving the discharge hold free and the meal which is blocking the discharge hold is melted by means of the electromagnetic device by varying the characteristics of the current flow.

2. Method as in claim 1, in which, when tapping is not in progress, the thickness of solidified metal in the tapping channel and in the discharge hold is controlled by stirring the metal by means of the electromagnetic device.

3. Method as in claim 1, in which, during the tapping step, the thickness of the metal solidified on the walls of the tapping channel is controlled by acting on the cooling system and on the current and frequency fed to the electromagnetic device.

4. Method as in claim 1, in which, when the discharge hole is closed, the sliding interception device includes, in alignment with the molten metal inside the discharge hole, a first part comprising a plate with a high resistance to heat, corrosion and erosion.

5. Method as in claim 1, in which, immediately after the discharge hole has been closed, the sliding interception device includes, in alignment with the discharge hole, a second part with a high heat conductivity.

6. Method as in claim 1, in which, when metal has solidified, the part of the sliding interception device aligned with the discharge hole is axially distanced from the front surface of the discharge hole.

7. Method as in claim 1, in which, at the end of melting, the sliding interception device is taken to a position of non-contact with the discharge hole and the electromagnetic device is fed with an intensity and frequency so as to cause at least the partial fusion of the solidified metal above the discharge hole.

8. Tapping device for molten metal from containers, the containers including in a lower part, a tapping channel having an end part with a discharge hole substantially vertical or sub-vertical, the discharge hole being closed at the lower part, at least temporally, with a sliding interception device, wherein the tapping channel comprises an electromagnetic device comprising spirals adjacent walls of the tapping channel and a system for cooling the walls, the device being characterized in that it comprises means to feed the electromagnetic device with electrical current and that the sliding interception device comprises at least a first part with a high resistance to heat shock, corrosion and erosion and at least a second part, positioned laterally adjacent to the first part, with high heat conductivity.

9. Device as in claim 8, in which the first part with a high resistance to heat shock, corrosion and erosion of the sliding interception device has at least a lining made of a material from the group consisting of alumina ($Al_2O_3$), zirconium oxide ($ZrO_2$), aluminium boride ($AlB_2$), aluminium nitride (AlN), aluminium and boron nitrate ($AlBN_2$), and zirconium bromide ($Z_rB_2$).

10. Device as in claim 8, in which the first part with a high resistance to heat shock, corrosion and erosion of the sliding interception device has notches and/or slots in the wall in front of the discharge hole.

11. Device as in claim 8 in which the second part of the sliding interception device includes at least a lining made of a material to which solid steel will not stick, from the group consisting of boron nitride powder and/or aluminium and boron nitrate.

12. Device as in claim 8, inclusive, in which the tapping channel comprises, in a substantially intermediate position between the floor of the container and the discharge hole, a chamber with a greater diameter.

13. Device as in claim 8, in which below the chamber with a greater diameter the tapping channel includes a segment shaped like a truncated cone (37) converging towards the bottom part at an angle of between 0 and 15°.

14. Device as in claim 8, in which the walls of the tapping channel are made of refractory or ceramic material and include in their thickness channels for the circulation of the cooling fluid, the winding of spirals being arranged on the outside of the walls.

15. Device as in claim 8, in which the walls of the tapping channel are made of metal with a high electric conductivity and include circumferential channels made in their thickness for the passage of the cooling fluid.

16. Device as in claim 8 in which the walls of the tapping channel are composed of adjacent longitudinal metallic elements, hollow inside to permit the passage of the cooling fluid.

17. Device as in claim 15, in which there is a layer of electrical insulation between the liquid metal in the tapping channel and the inner surface of the metallic walls.

18. Device as in claim 8, in which the first part of the interception device (19) comprises a lower support element made of metal and one or more layers of lining made of a highly heat resistant material.

19. Device as in claim 8, in which the second part of the sliding interception device comprises cooling means with the circulation of cooling fluid.

20. Device as in claim 16, in which there is a layer of electrical insulation between the liquid metal in the tapping channel and the inner surface of the metallic walls.

21. Tapping device for molten metal from containers, including at a lower part of the container a tapping channel surrounded by walls, leading from the lower part of the container to a discharge hole, the tapping channel being substantially vertical in orientation, the discharge hold abutting a sliding interception device, which in operation serves to cover and uncover the discharge hole, wherein the tapping channel comprises an electromagnetic deice comprising coils and a cooling means for cooling the walls, wherein the tapping deice comprises means to feed the electromagnetic device with electrical current, and the sliding interception device comprises at least a first plate shaped part made of a refractory lining material from the group consisting of alumina, zirconium oxide, aluminum boride, aluminum nitride, aluminum nitrate, boron nitrate and zirconium bromide, and a second, adjacent plate shaped part and including cooling means for the circulation of a cooling fluid through the second plate shaped part.

22. Method as in claim 5, wherein the second part of the sliding interception device comprises cooling means with the circulation of cooling fluid, and in which, in the end-of-tapping step, the cooling means is activated to cool the second part to solidify metal over the second part.

* * * * *